US005647218A

United States Patent [19]

Kuriyama et al.

[11] Patent Number: 5,647,218

[45] Date of Patent: Jul. 15, 1997

[54] COOLING SYSTEM HAVING PLURAL COOLING STAGES IN WHICH REFRIGERATE-FILLED CHAMBER TYPE REFRIGERATORS ARE USED

[75] Inventors: Toru Kuriyama; Yasumi Ohtani; Rohana Chandratilleke, all of Yokohama; Tatsuya Yoshino, Tokyo; Takayuki Kobayashi, Yokohama, all of Japan

[73] Assignee: Kabushiki Kaisha Toshiba, Kawasaki, Japan

[21] Appl. No.: 645,715

[22] Filed: May 14, 1996

[30] Foreign Application Priority Data

May 16, 1995 [JP] Japan ..... 7-117561

[51] Int. Cl.[6] ..... F25B 9/00

[52] U.S. Cl. ..... 62/6; 62/175; 62/332

[58] Field of Search ..... 62/6, 175, 332

[56] References Cited

U.S. PATENT DOCUMENTS

| | | | |
|---|---|---|---|
| 3,473,342 | 10/1969 | Leyarovski et al. | 62/606 |
| 3,914,950 | 10/1975 | Fletcher et al. | 62/608 |
| 4,077,231 | 3/1978 | Fletcher | 62/608 |
| 4,313,309 | 2/1982 | Lehman, Jr. | 62/175 |
| 4,700,545 | 10/1987 | Ishibashi et al. | 62/6 |
| 5,010,737 | 4/1991 | Okumura et al. | 62/6 |
| 5,231,846 | 8/1993 | Goshaw et al. | 62/175 |
| 5,335,505 | 8/1994 | Ohtani et al. | 62/6 |
| 5,412,952 | 5/1995 | Ohtani et al. | 62/6 |
| 5,426,949 | 6/1995 | Saito et al. | 62/55.5 |
| 5,447,034 | 9/1995 | Kuriyama et al. | 62/51.1 |

FOREIGN PATENT DOCUMENTS 3-194364 8/1991 Japan .

*Primary Examiner*—Ronald C. Capossela

*Attorney, Agent, or Firm*—Oblon, Spivak, McClelland, Maier & Neustadt, P.C.

[57] ABSTRACT

A cooling apparatus comprises a main refrigerator having a refrigerant-filled chamber, a sub-refrigerator connected parallel to the main refrigerator and having a refrigerant-filled chamber, switch control means for controlling the switching operation between the supply of a refrigerant used in the main refrigerator to the sub-refrigerator, and the stop of the supply of the refrigerant, on the basis of predetermined conditions.

24 Claims, 7 Drawing Sheets

COOLING SYSTEM HAVING PLURAL COOLING STAGES IN WHICH REFRIGERATE-FILLED CHAMBER TYPE REFRIGERATORS ARE USED

BACKGROUND OF THE INVENTION

1. Field of the Invention

This invention relates to a cooling system for cooling an object to a very low temperature, such as a refrigerant-filled chamber type refrigerator, a superconducting magnet apparatus, etc.

2. Description of the Related Art

It is known that most of superconducting magnet apparatuses now put to practice employ both an immersion cooling system wherein a superconducting coil and a cryogenic refrigerant such as liquid helium are contained in an adiabatic container, and a system wherein a thermal shield embedded in an adiabatic layer of the adiabatic container is cooled by a cryogenic refrigerator. Moreover, a superconducting magnet apparatus which employs a refrigerator direct cooling system is now being developed. In this apparatus, a superconducting coil contained in an adiabatic container is directly cooled by a cryogenic refrigerator.

Many of such superconducting magnet apparatuses use a refrigerant-filled chamber type refrigerator as a cryogenic refrigerator, on the grounds that it has a small size and can realize a sufficiently low temperature. The refrigerant-filled chamber type refrigerator usually employs a plural-stage expansion type cooling system with a plurality of refrigerant-filled chambers, and a gas control system for introducing gas of high pressure into the overall cooling system and exhausting gas therefrom in an alternate manner. A typical refrigerant-filled chamber type refrigerator employs the Gifford-McMahon refrigerating cycle.

To cool a superconducting coil less than its critical temperature by a refrigerator direct cooling method, a refrigerant-filled chamber type refrigerator which employs a two-stage expansion system is usually used. This refrigerator cools the thermal shield to about 50 K. in a first cooling stage, and the superconducting coil to about 5 K. in a second cooling stage.

It is desirable to minimize the pre-cooling time required to cool the superconducting coil less than its critical temperature. In the case of using the refrigerant-filled chamber type refrigerator constructed as above, however, more than 50 hours are usually required for the following reason:

FIG. 1 shows examples of cooling capacities of the first and second cooling stages in the refrigerant-filled chamber type refrigerator, which employs the two-stage expansion system and the Gifford-McMahon refrigerating cycle. As is evident from FIG. 1, the cooling capacity of the first or second cooling stage is substantially constant within a range of from the room temperature (300 K.) to about 100 K. In other words, in this temperature range, the required pre-cooling time cannot be shortened even when a large amount of gas is supplied from the gas control system, since the amount of heat absorption is inherently limited.

SUMMARY OF THE INVENTION

It is the object of the invention to provide a refrigerant-filled chamber type refrigerator and a superconducting magnet apparatus, which can shorten the required pre-cooling time without increasing the capacity of a gas control system.

According to a first aspect of the invention, there is provided a cooling apparatus comprising:

a first refrigerator supplied with a refrigerant;

a second refrigerator connected parallel to the first refrigerator for receiving a flow of the refrigerant from the first refrigerator; and a controller for regulating the flow of the refrigerant from the first refrigerator to the second refrigerator in accordance with a selected condition.

According to a second aspect of the invention, there is provided a superconducting magnet apparatus comprising:

a first refrigerator supplied with a refrigerant;

a second refrigerator connected parallel to the first refrigerator for receiving a flow of the refrigerant from the first refrigerator; and a controller for regulating the flow of the refrigerant from the first refrigerator to the second refrigerator in accordance with a selected condition.

According to a third aspect of the invention, there is provided a cooling apparatus comprising:

a first refrigerator;

a second refrigerator connected parallel to the first refrigerator for circulating a refrigerant received from the first refrigerator;

a valve through which the second refrigerator is connected parallel to the first refrigerator; and a controller for controlling the valve so as to regulate a flow of the refrigerant between the first and second refrigerators.

According to a fourth aspect of the invention, there is provided a superconducting magnet apparatus comprising:

a superconducting coil unit; and a cooling unit for cooling the superconducting coil unit, including a first refrigerator, a second refrigerator connected parallel to the first refrigerator for circulating a refrigerant received from the first refrigerator, a valve through which the second refrigerator is connected parallel to the first refrigerator, and a controller for controlling the valve so as to regulate a flow of the refrigerant between the first and second refrigerators.

Since in the invention constructed as above, the first and second refrigerators are connected parallel to each other, both the first and second refrigerators can be used to pre-cool the superconducting coil unit as a to-be-cooled object. Thus, extra gas in the first refrigerator can be effectively used for pre-cooling, and accordingly the time required for pre-cooling can be shortened.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention and, together with the general description given above and the detailed description of the preferred embodiments given below, serve to explain the principles of the invention.

DETAILED DESCRIPTION OF THE PREFERRED EMBODIMENTS

The embodiments of the invention will be explained with reference to the accompanying drawings.

Figure 2:
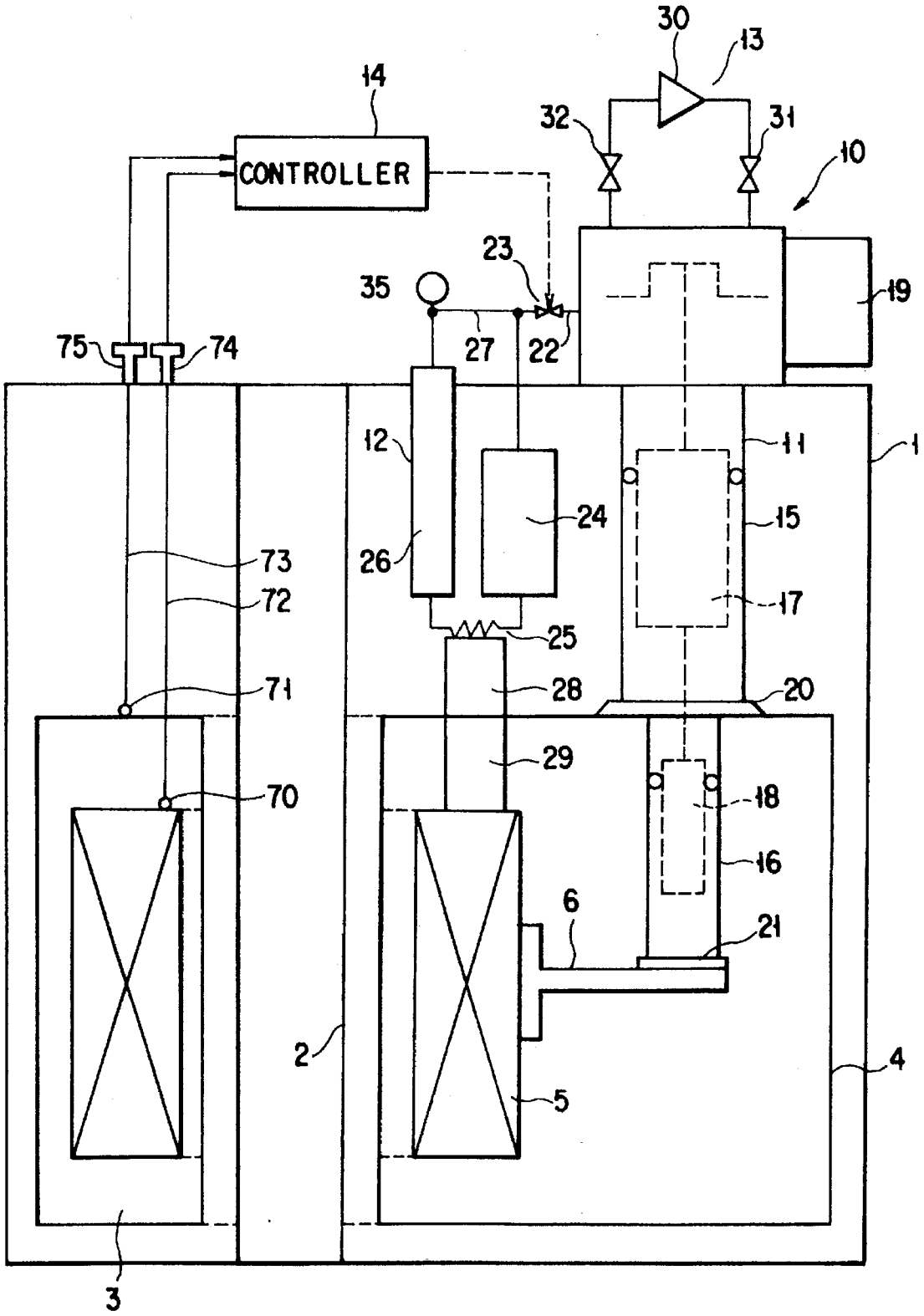
FIG. 2 is a schematic diagram, showing a superconducting magnet apparatus which incorporates a refrigerant-filled chamber type refrigerator according to an embodiment of the invention.

FIG. 2 shows a superconducting magnet apparatus which incorporates a refrigerant-filled chamber type refrigerator according to an embodiment of the invention. In this case, the apparatus employs a refrigerator direct cooling system.

In FIG. 2 shows a vacuum container 1. A vertical hole is formed through the vacuum container 1, thereby forming a cylindrical inner wall 2. A thermal shield 4 is provided in the vacuum container 1 to define therein an annular space 3 which surrounds the cylindrical wall 2. A superconducting coil 5 is located concentric with the cylindrical wall 2 in the annular space 3 defined by the thermal shield 4. The superconducting coil 5 consists of a superconducting wire whose critical temperature is, for example, about 15 K., and which has both opposite ends lead to the outside by means of current lead wires (not shown). A thermally conductive member 6 formed of copper, etc. is attached, for example, to a peripheral surface portion of the superconducting coil 5.

A refrigerant-filled chamber type refrigerator 10 is located partially in the vacuum container 1 and partially out of the same, for keeping the temperature conditions of the superconducting coil 5 (specifically, for cooling the thermal shield 4 to about 50 K. and the superconducting coil 5 to about 5 K.).

The refrigerant-filled chamber type refrigerator 10 comprises a main refrigerator 11; a pulse tube refrigerator 12 located parallel to the main refrigerator 11 and serving as a sub-refrigerator; a gas control system 13 for supplying the main refrigerator 11 with highly pressurized helium gas and discharging helium gas therefrom; and a controller 14 for closing a communication passage between the main refrigerator 11 and the pulse tube refrigerator 12 on the basis of an output from a temperature sensor 70 attached to the superconducting coil 5 or from a temperature sensor 71 attached to the thermal shield 4, when the temperature of the thermal shield 4 and/or the superconducting coil 5 reaches a predetermined low level. Lead wires 72 and 73 lead from the temperature sensors 70 and 71 attached to the superconducting coil 5 and the thermal shield 4, respectively, are connected to the controller 14 via output ports 74 and 75, respectively.

In this embodiment, the main refrigerator 11 employs the two-stage expansion system and the Gifford-McMahon refrigerating cycle. Specifically, the main refrigerator 11 has a first-stage cooling section 15 and a second-stage cooling section 16. Displacers 17 and 18, which hold respective refrigerant-filled chambers, are contained in the first- and second-stage cooling sections 15 and 16, respectively. The displacers 17 and 18 are disposed to vertically reciprocate in synchronism with the rotation of a motor 19. A first cooling stage 20 provided for the first-stage cooling section 15 is thermally connected to the thermal shield 4, while a second cooling stage 21 provided for the second-stage cooling section 16 is thermally connected to the thermally conductive member 6. A copper net is used as a coldness-accumulating material in the refrigerant-filled chamber held by the displacer 17. On the other hand, a magnetic coldness-accumulating material, such as $Er_3Ni$, which uses an abnormal magnetic specific heat, etc. due to magnetic phase transfer, is used as a coldness-accumulating material in the refrigerant-filled chamber unit held by the displacer 18.

The pulse tube refrigerator 12 constituting the sub-refrigerator includes a pipe 22 which has its one end connected to the gas introducing/discharging port of the main refrigerator 11, and the other end connected to one connection port of a refrigerant-filled chamber 24 via an electromotive valve 23. The other connection port of the refrigerant-filled chamber 24 is connected to one end of a pulse tube 26 via a heat absorption tube 25. The other end of the pulse tube 26 is connected to the outlet of the electromotive valve 23 via a buffer tank 35 and a capillary tube 27. In other words, the pulse tube refrigerator 12 is of a double-inlet type. Those portions of the refrigerant-filled chamber 24, the heat absorption tube 25 and the pulse tube 26, which are other than high-temperature portions, are located in a space defined between the upper wall of the vacuum container 1 and the thermal shield 4. A copper net or the like is used as a coldness-accumulating material in the refrigerant-filled chamber 24.

Thermal switches 28 and 29 are interposed between the heat absorption tube 25 and the thermal shield 4 and between the thermal shield 4 and the superconducting coil 5, respectively. Each of the switches 28 and 29 contains a pair of thermally conductive toothed members vertically engaged with each other, and nitrogen gas, etc. in a gas-tight manner.

The gas control system 13 includes a compressor 30, a high pressure valve 31 to be opened and closed in synchronism with the rotation of the motor 19, and a low pressure valve 32. The gas control system 13 constitutes a helium gas circulation system via the main refrigerator 11. The gas control system 13 compresses, using the compressor 30, low pressure helium gas (of about 8 atm) and supplies highly pressurized helium gas (of about 20 atm) into the main refrigerator 11. Further, the gas control system 13 exhausts helium gas from the main refrigerator 11. The supply and exhaustion of helium gas are performed alternately.

The controller 14 is adapted to close the electromotive valve 23 when the temperature of the thermal shield 4 or the superconducting coil 5 reaches a predetermined low level.

That operation of the refrigerant-filled chamber type refrigerator incorporated in the superconducting magnet apparatus constructed as above, which is performed at the time of pre-cooling, will now be explained.

When the motor 19 starts to rotate, the displacers 17 and 18 start to reciprocate. In synchronism with the reciprocation, the high pressure valve 31 and the low pressure valve 32 are opened or closed, thereby starting the operation of the main refrigerator 11. At the first and second cooling stages 20 and 21 in the main refrigerator 11, refrigeration is performed in the same manner as in the case of the conventional two-stage expansion type refrigerator which employs the Gifford-McMahon refrigerating cycle. Thus, the first cooling stage 20 starts to absorb heat from the thermal shield 4, while the second cooling stage 21 starts to absorb heat from the superconducting coil 5.

Since at this time, the temperature of the thermal shield 4 or the superconducting coil 5 does not reach the predetermined low level, the electromotive valve 23 is controlled open. Accordingly, the low temperature end of the pulse tube 12, i.e. the heat absorption tube 25, is cooled by high/low pressure waves created within the main refrigerator 11 as a result of the opening/ closing of the high pressure valve 31 and the low pressure valve 32. In other words, opening the electromotive valve 23 effectively guides, into the pulse tube refrigerator 12 as the sub-refrigerator, that extra helium gas in the main refrigerator 11, which is made to bypass the to-be-cooled section at the time of pre-cooling in the conventional case.

Since at this time, nitrogen gas filled in the thermal switches 28 and 29 is in the state of gas, the absorption tube 25 is thermally connected to the thermal shield 4 via the thermal switch 28, and the thermal shield 4 to the superconducting coil 5 via the thermal switch 29. Accordingly, the heat absorption tube 25, i.e. the pulse tube refrigerator 12, also starts to absorb heat from the superconducting coil 5.

As explained above, both the main refrigerator 11 and the pulse tube refrigerator 12 absorb heat from the thermal shield 4 and the superconducting coil 5, effectively using helium gas discharged from the compressor 30. Therefore, the amount of absorption heat can significantly be increased as compared with the case where pre-cooling is performed only by the main refrigerator 11, thereby shortening the time required for pre-cooling.

When the pre-cooling operation is continued until nitrogen gas contained in the thermal switches 28 and 29 are frozen, the interior of each of the switches 28 and 29 turns into a vacuum state, which means that the switches are turned off. Further, when the temperature of the thermal shield 4 or the superconducting coil 5 reaches 70 K. at which nitrogen gas is frozen, the controller 14 operates to close the electromotive valve 23 in response to the output of the temperature sensor 70 or 71. Thus, at this time, the pulse tube refrigerator 12 is separated from the main refrigerator 11, and therefore the main refrigerator 11 refrigerates all helium gas discharged from the compressor 30.

As described above, providing the pulse tube refrigerator 12 parallel to the main refrigerator 11 enables extra helium gas in the main refrigerator 11 to be guided to the pulse tube refrigerator 12 at the time of pre-cooling, which means that all helium gas supplied from the gas control system 13 can be used for pre-cooling. This contributes to shortening the time required for pre-cooling. According to our experiments, 70 hours required for pre-cooling in the case of using only the main refrigerator 11 could be reduced to 12 hours in the case of using both the main refrigerator 11 and the pulse tube refrigerator 12.

Figure 3:
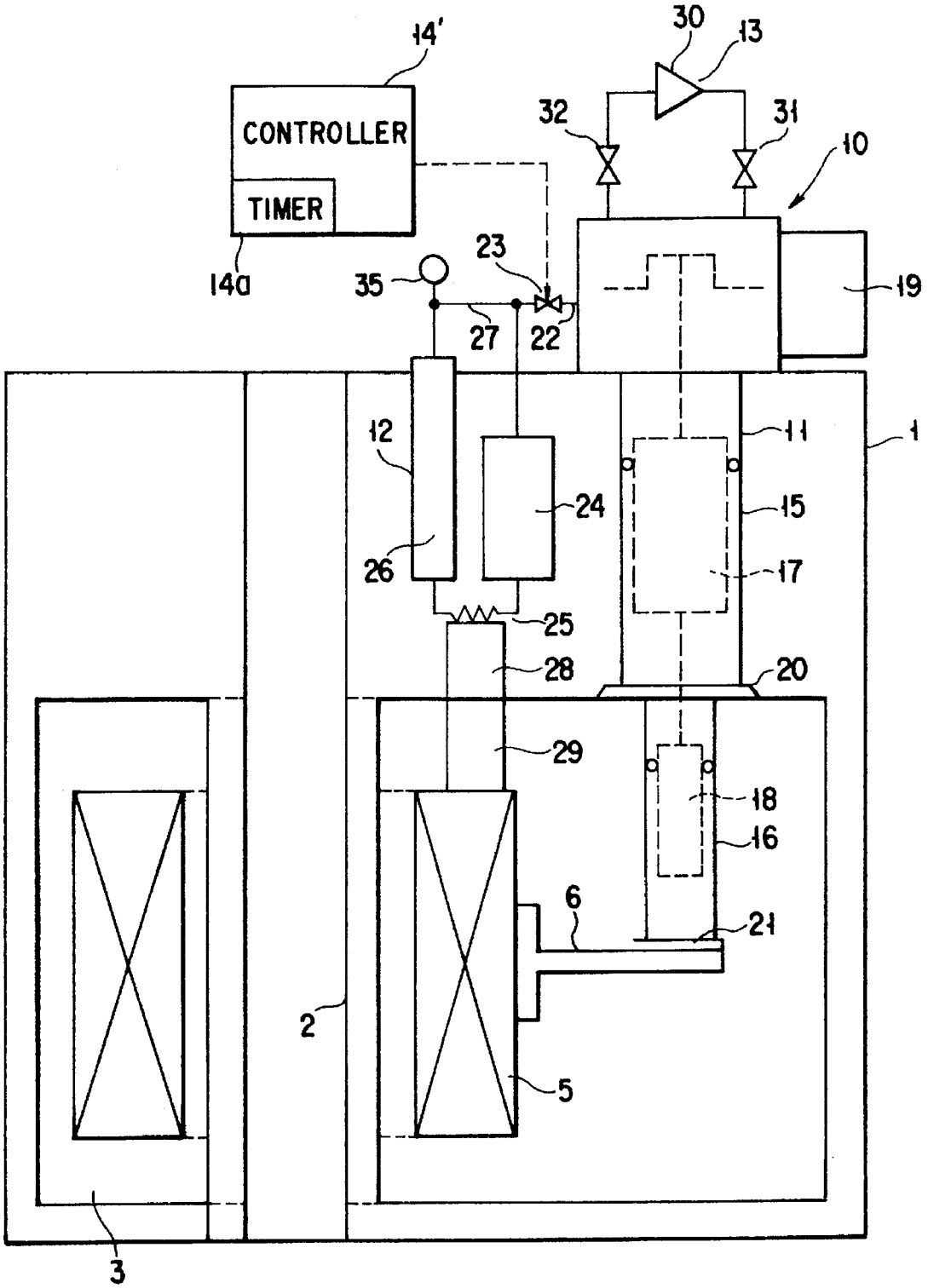
FIG. 3 is a schematic diagram, showing a superconducting magnet apparatus which incorporates a refrigerant-filled chamber type refrigerator according to another embodiment of the invention.

FIG. 3 shows a superconducting magnet apparatus which incorporates a refrigerant-filled chamber type refrigerator 10*a* according to another embodiment of the invention. In this case, too, the superconducting magnet apparatus uses the refrigerator direct cooling system. In FIG. 3, elements similar to those shown in FIG. 2 are denoted by corresponding reference numerals. No detailed explanation will be given of such elements.

This embodiment incorporates a controller 14' which differs from the controller 14 shown in FIG. 2. The controller 14 shown in FIG. 2 operates on the basis of the outputs of the temperature sensors 70 and 71, whereas the controller 14' shown in FIG. 3 does not require the sensors 70 and 71, but a timer 14*a*. The timer 14*a* calculates the point of time at which the temperature of the thermal shield 4 and/or the superconducting coil 5 reaches the predetermined low level. When a predetermined period of time passes after the supply of a refrigerant gas to the pulse tube refrigerator 12 as the sub-refrigerator is started, the thermal shield 4 and/or the superconducting coil 5 reaches the predetermined low temperature. The timer 14*a* calculates this period of time (and accordingly a point of time at which it or they reach the predetermined low temperature), and the controller 14' closes the communication passage between the main refrigerator 11 and the pulse tube refrigerator 12 at the time point calculated by the timer 14*a*. This structure does not need the temperature sensors 70 and 71, and hence is advantageous in manufacturing the apparatus.

Figure 4:
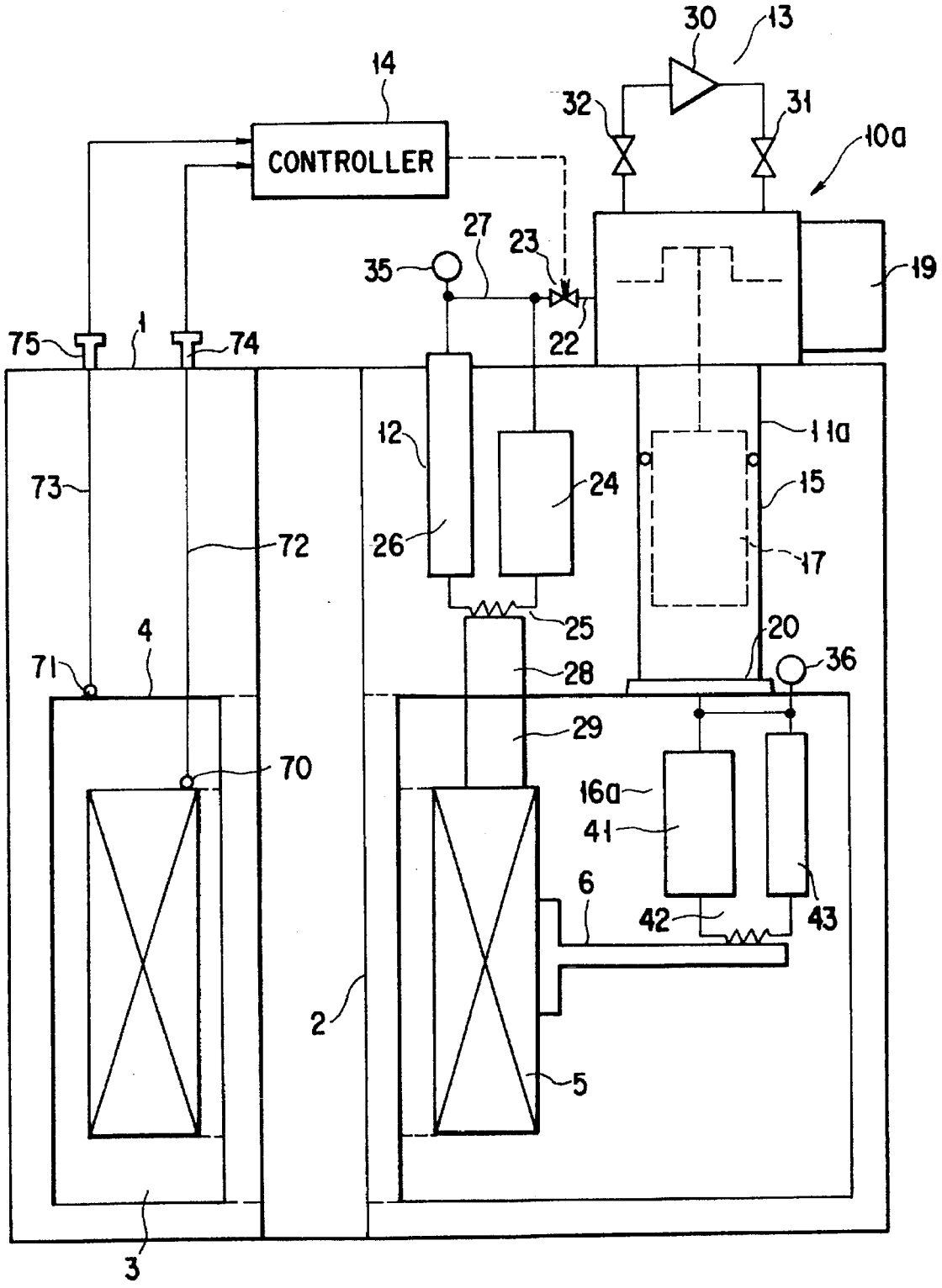
FIG. 4 is a schematic diagram, showing a superconducting magnet apparatus which incorporates a refrigerant-filled chamber type refrigerator according to a further embodiment of the invention.

FIG. 4 shows a superconducting magnet apparatus which incorporates a refrigerant-filled chamber type refrigerator 10*a* according to yet another embodiment of the invention. In this case, too, the superconducting magnet apparatus employs the refrigerator direct cooling system. In FIG. 4, elements similar to those shown in FIG. 2 are denoted by corresponding reference numerals. No detailed explanation will be given of such elements.

The refrigerant-filled chamber type refrigerator 10*a* used in this embodiment differs from the FIG. 2 refrigerator in a main refrigerator 11*a*.

In the main refrigerator 11*a*, the first-stage cooling section 15 is of the Gifford-McMahon refrigerating cycle type, and a second-stage cooling section 16*a* employs a double-inlet system of a pulse tube refrigerating cycle type. Specifically, the section 16*a* comprises a refrigerant-filled chamber 41, a heat absorption tube 42, a pulse tube 43 and a buffer tank 36. The absorption tube 42 is thermally connected to the heat conductive member 6.

Even in the case of using the main refrigerator 11*a* constructed as above, the same advantage as in the FIG. 2 refrigerator can be obtained.

Figure 5:
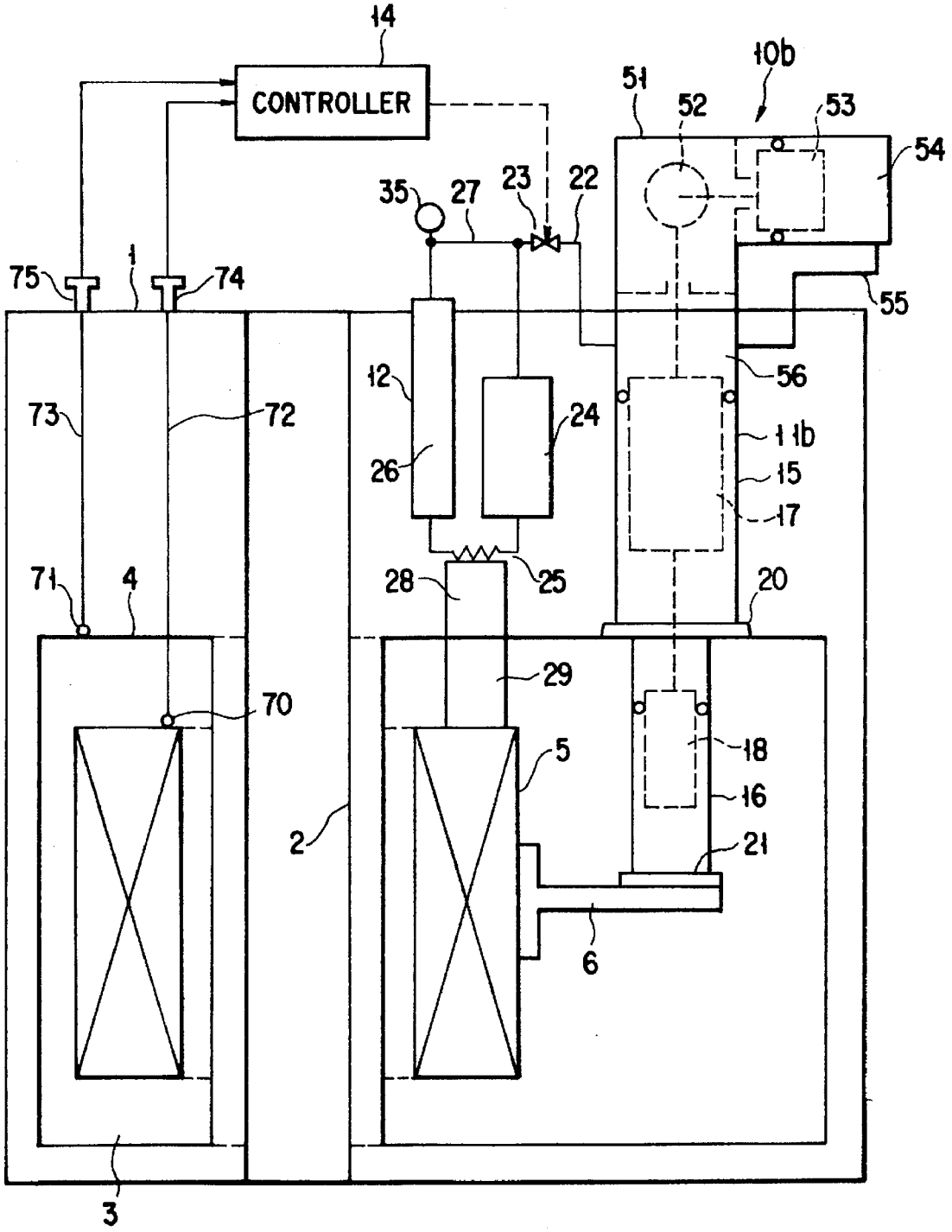
FIG. 5 is a schematic diagram, showing a superconducting magnet apparatus which incorporates a refrigerant-filled chamber type refrigerator according to yet another embodiment of the invention.

FIG. 5 shows a superconducting magnet apparatus which incorporates a refrigerant-filled chamber type refrigerator 10*b* according to a further embodiment of the invention. In this case, too, the superconducting magnet apparatus employs the refrigerator direct cooling system. In FIG. 5, elements similar to those shown in FIG. 2 are denoted by corresponding reference numerals. No detailed explanation will be given of such elements.

The refrigerant-filled chamber type refrigerator 10*b* used in this embodiment differs from the FIG. 2 refrigerator in a main refrigerator 11*b*.

The main refrigerator 11*b* employs a Stirling refrigerating cycle. The first- and second-stage cooling sections 15 and 16 included in the main refrigerator 11*b* have the same structure as the structure of FIG. 2 which uses the Gifford-McMahon refrigerating cycle. In the main refrigerator 11*b*, displacers 17 and 18 are reciprocated by a crank mechanism 52 provided in a crank chamber 51. The crank chamber 51 is separated from the main refrigerator 11*b* by means of a seal mechanism. Further, the crank mechanism 52 is rotated by a motor (not shown).

The crank chamber 51 also contains a piston 53 to be reciprocated by the crank mechanism 52 with a predetermined phase difference kept relative to the reciprocation phase of the displacers 17 and 18, and a chamber 54 having its volume varied by the piston 53. The chamber 54 communicates with a gas inlet/outlet space 56 in the main refrigerator 11*b* through a pipe 55. The closed space defined by the chamber 54, the pipe 55 and the main refrigerator 11*b* is filled with helium gas. The inlet of the electromotive valve 23 communicates with the gas inlet/outlet space 56.

The Stirling refrigerating cycle and the Gifford-McMahon refrigerating cycle are based on the same refrigeration principle. Specifically, rotation of the crank mechanism 52 causes reciprocation of the piston 53, thereby repeating the operation of compressing helium gas in the chamber 54 to push it out of the chamber, and the operation of sucking helium gas into the chamber. This means that the chamber 54 performs substantially the same operation as the combination of the compressor 30, the high pressure valve 31 and the low pressure valve 32 shown in FIGS. 2 to 4.

Although in the case of the Stirling refrigerating cycle, no extra helium gas is generated at the time of pre-cooling, the same advantage as in the case of the refrigerant-filled chamber type refrigerator shown in FIGS. 2 to 4 can be obtained by supplying the pulse tube refrigerator 12 with part of helium gas used in the Stirling refrigerating cycle.

Figure 6:
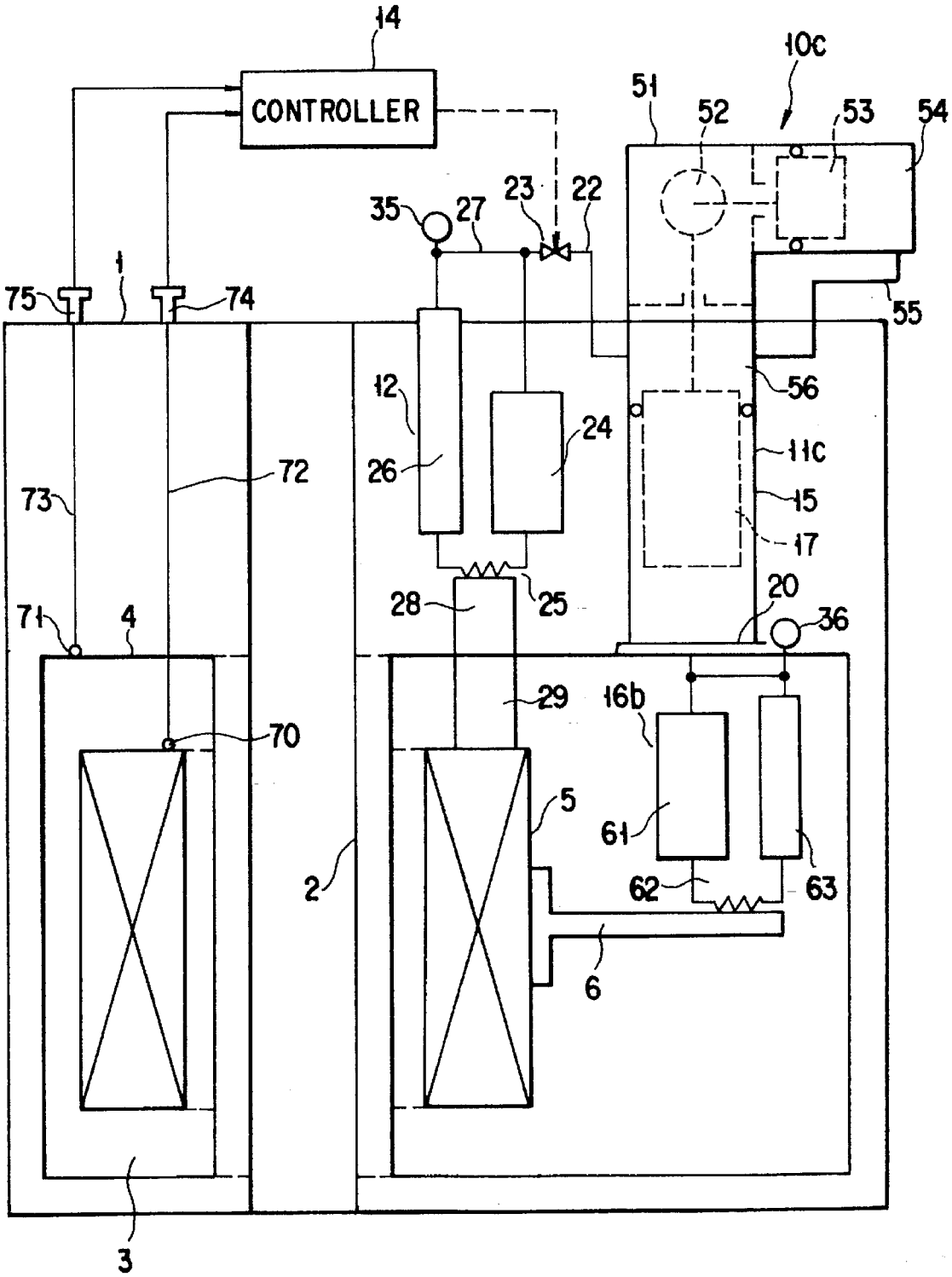
FIG. 6 is a schematic diagram, showing a superconducting magnet apparatus which incorporates a refrigerant-filled chamber type refrigerator according to another embodiment of the invention.

FIG. 6 shows a superconducting magnet apparatus which incorporates a refrigerant-filled chamber type refrigerator 10*c* according to a furthermore embodiment of the invention. In this case, too, the super-conducting magnet apparatus employs the refrigerator direct cooling system. In FIG. 6, elements similar to those shown in FIG. 5 are denoted by corresponding reference numerals. No detailed explanation will be given of such elements.

The refrigerant-filled chamber type refrigerator 10*c* used in this embodiment differs from the FIG. 5 refrigerator in a main refrigerator 11*c*.

In the main refrigerator 11*c*, the first-stage cooling section 15 employs the Stirling refrigerating cycle, while a second-stage cooling section 16*c* employs the double-inlet system of the pulse tube refrigerating cycle type, and comprises a refrigerant-filled chamber 61, a heat absorption tube 62, and a pulse tube 63. The heat absorption tube 62 is thermally connected to the thermally conductive member 6.

Also in this case, the same advantage as in the case of the refrigerant-filled chamber type refrigerator shown in FIGS. 2 to 4 can be obtained.

Figure 1:
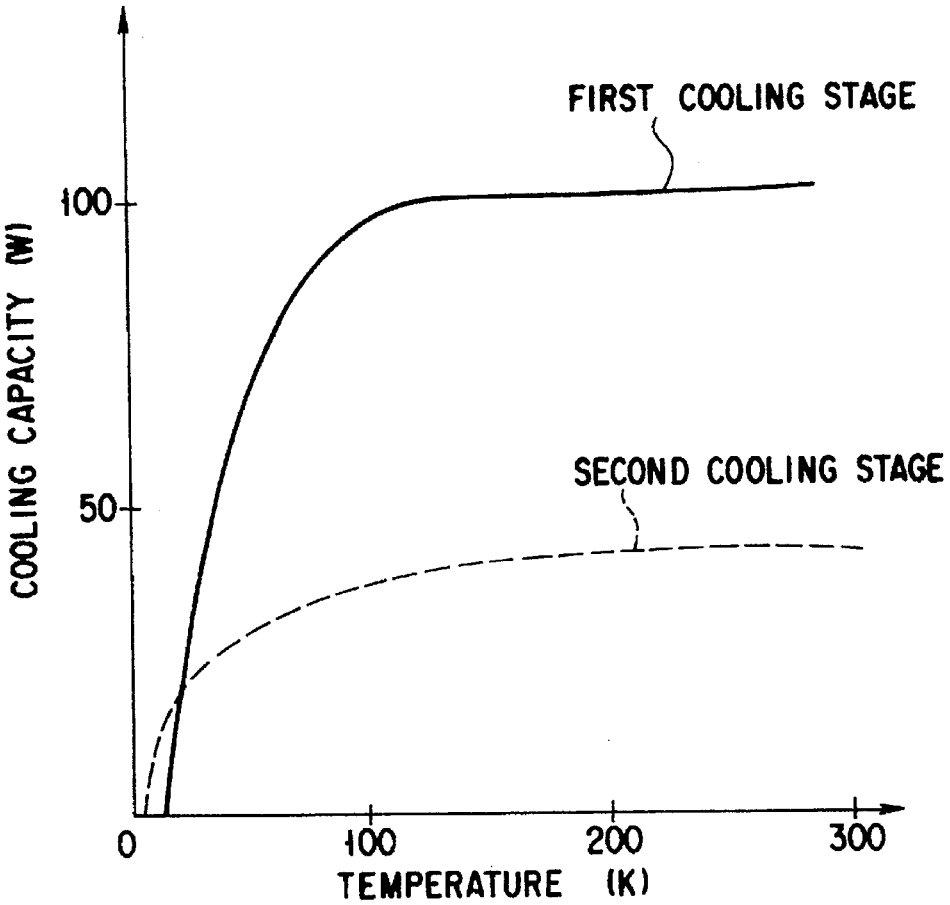
FIG. 1 is a graph, illustrating an example of a cooling capacity of each cooling stage in a refrigerant-filled chamber type refrigerator with a two-stage expansion system.
Figure 8:
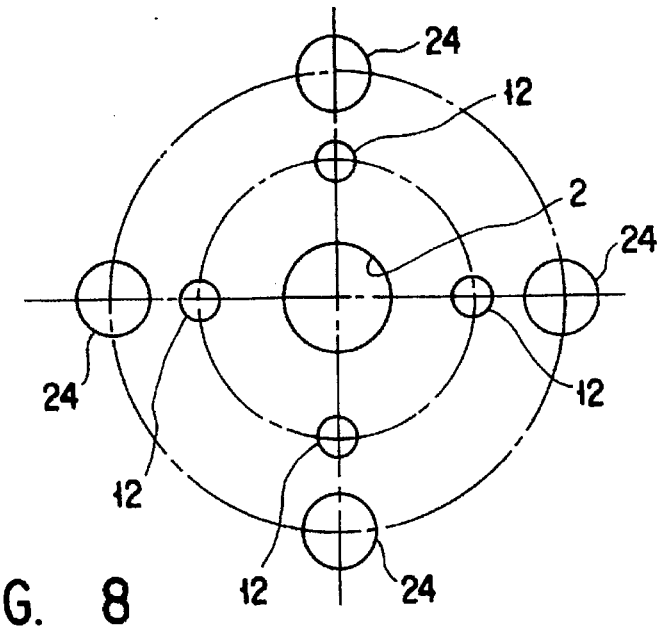
FIG. 8 is a sectional view, taken along lines VIII—VIII in FIG. 7.
Figure 7:
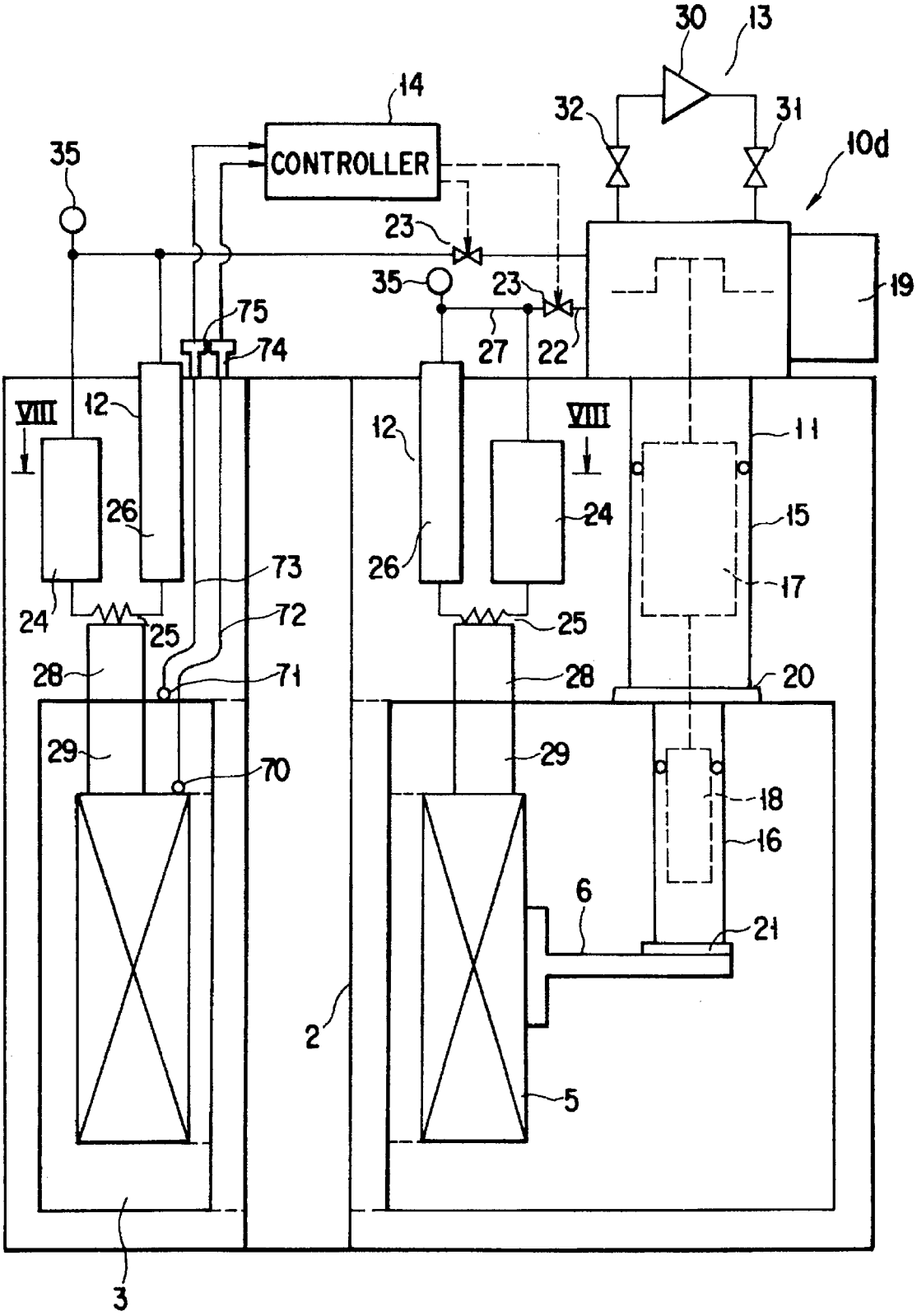
FIG. 7 is a schematic diagram, showing a superconducting magnet apparatus which incorporates a refrigerant-filled chamber type refrigerator according to a furthermore embodiment of the invention.

FIGS. 7 and 8 show a superconducting magnet apparatus which incorporates a refrigerant-filled chamber type refrigerator 10*d* according to a yet another embodiment of the invention. In this case, too, the superconducting magnet apparatus uses the refrigerator direct cooling system. In FIGS. 7 and 8, elements similar to those shown in FIG. 2 are denoted by corresponding reference numerals. No detailed explanation will be given of such elements.

This embodiment significantly differs from the FIG. 2 embodiment by the structure of the refrigerant-filled chamber type refrigerator 10*d* and the manner of cooling the superconducting coil 5. The refrigerator 10*d* comprises a main refrigerator 11 and four pulse tube refrigerators 12 serving as sub-refrigerators.

Like the refrigerant-filled chamber type refrigerator shown in FIG. 2, the main refrigerator 11 of the embodiment employs the Gifford-McMahon refrigerating cycle wherein the refrigerant-filled chamber is movable. Further, each of the four sub-refrigerators 12 is similar to the sub-refrigerator 12 incorporated in the refrigerant-filled chamber type refrigerator of FIG. 2.

As is shown in FIG. 8, the four sub-refrigerators 12 have the same size and structure. They are thermally connected to the superconducting coil 5, and arranged around the superconducting coil 5 at intervals of 90° with the same attitude relative to the axis of the coil.

This structure reliably cools the superconducting coil 5 on the same principle as in the FIG. 2 apparatus, and can provide the same advantage as in the FIG. 2 apparatus.

In addition, in this embodiment, the stationary four sub-refrigerators 12 are arranged around the superconducting coil 5 at regular intervals, and the heat absorption portions (i.e. cooling stages) of the sub-refrigerators 12 are thermally connected to the superconducting coil 5. Therefore, the superconducting coil 5 can be cooled uniformly such that no temperature difference will occur in the overall coil. Moreover, since the sub-refrigerators 12 arranged around the superconducting coil 5 at regular intervals cools the superconducting coil 5, even if a magnetic coldness-accumulating material is used in the refrigerant-filled chamber 24 of each sub-refrigerator 12, the magnetic coldness-accumulating material will not greatly distort the symmetry of the magnetic field created by the superconducting coil 5. Accordingly, correction for enhancing the symmetry can be performed easily.

The invention is not limited to the above-described embodiments. To effectively create refrigerant gas in the pulse tube refrigerator, it is desired to provide a predetermined difference between the phase of pressure variation and that of gas variation. To this end, the high temperature end of the pulse tube may be connected to a buffer tank, etc. via a capillary tube or an appropriate restricting element. Furthermore, the pulse tube refrigerator my be used as the main refrigerator. The main refrigerator may employ a modification-type Solvay refrigerating cycle, as well as the Gifford-McMahon refrigerating cycle and the Stirling refrigerating cycle. Moreover, the Gifford-McMahon refrigerating cycle, the Stirling refrigerating cycle or the modification-type Solvay refrigerating cycle type refrigerator may be used as the sub-refrigerator, instead of the pulse tube refrigerator. Also, it is a matter of course that the refrigerant-filled chamber type refrigerator of the invention is used to cool not only the superconducting coil but also other elements.

As explained above, the invention can shorten the time required for pre-cooling.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. A cooling apparatus comprising:

a first refrigerator supplied with a refrigerant;

a second refrigerator connected parallel to the first refrigerator for receiving a flow of the refrigerant from the first refrigerator; and a controller for regulating the flow of the refrigerant from the first refrigerator to the second refrigerator in accordance with a selected condition.

2. The cooling apparatus according to claim 1, wherein the controller has means for supplying the second refrigerator with the refrigerant in an initial stage of cooling, and stopping the supply of the refrigerant to the second refrigerator when the temperature of a to-be-cooled object has become lower than a predetermined level.

3. The cooling apparatus according to claim 2, wherein the controller has a temperature sensor for sensing the temperature of the to-be-cooled object, and means for supplying the refrigerant to the second refrigerator on the basis of the temperature of the object sensed by the temperature sensor.

4. The cooling apparatus according to claim 1, wherein the controller has means for supplying the second refrigerator with the refrigerant in an initial stage of cooling, and stopping the supply of the refrigerant to the second refrigerator after the refrigerant is supplied to the second refrigerator for a predetermined period of time.

5. The cooling apparatus according to claim 4, wherein the controller has a timer for counting the period of time for which the refrigerant is supplied to the second refrigerator, and means for controlling the supply of the refrigerant to the second refrigerator on the basis of the time period counted by the counter.

6. The cooling apparatus according to claim 1, wherein the first refrigerator is formed of one of a Gifford-McMahon refrigerating cycle type refrigerator, a Stirling refrigerating cycle type refrigerator, a modification-type Solvay refrigerating cycle type refrigerator, and a pulse tube refrigerator.

7. The cooling apparatus according to claim 1, wherein the second refrigerator is formed of one of a pulse tube refrigerator, a Gifford-McMahon refrigerating cycle type refrigerator, a Stirling refrigerating cycle type refrigerator, and a modification-type Solvay refrigerating cycle type refrigerator.

8. The cooling apparatus according to claim 1, wherein the first refrigerator includes a plurality of cooling stages, at least a first cooling stage included in the cooling stages using one of a Gifford-McMahon refrigerating cycle type refrigerator, a Stirling refrigerating cycle type refrigerator, and a modification-type Solvay refrigerating cycle type refrigerator, and cooling stages other than the first cooling stage using pulse tube refrigerating cycle type refrigerators connected in series to the refrigerator used in the first cooling stage.

9. A superconducting magnet apparatus comprising:

a superconducting coil unit; and a cooling unit for cooling the superconducting unit, including a first refrigerator supplied with a refrigerant, a second refrigerator connected parallel to the first refrigerator for receiving a flow of the refrigerant from the first refrigerator, and a controller for regulating the flow of the refrigerant from the first refrigerator to the second refrigerator in accordance with a selected condition.

10. The superconducting magnet apparatus according to claim 9, wherein the cooling unit has means for directly cooling a superconducting coil included in the superconducting coil unit.

11. The superconducting magnet apparatus according to claim 9, wherein the cooling unit has means for directly cooling a container which contains a superconducting coil included in the superconducting coil unit.

12. The superconducting magnet apparatus according to claim 9, wherein the second refrigerator has a plurality of refrigerators located in the super-conducting coil unit.

13. A cooling apparatus comprising:

a first refrigerator;

a second refrigerator connected parallel to the first refrigerator for circulating a refrigerant received from the first refrigerator;

a valve through which the second refrigerator is connected parallel to the first refrigerator; and a controller for controlling the valve so as to regulate a flow of the refrigerant between the first and second refrigerators.

14. The cooling apparatus according to claim 13, wherein the controller has means for supplying the second refrigerator with the refrigerant in an initial stage of cooling, and stopping the supply of the refrigerant to the second refrigerator when the temperature of a to-be-cooled object has become lower than a predetermined level.

15. The cooling apparatus according to claim 14, wherein the controller has a temperature sensor for sensing the temperature of the to-be-cooled object, and means for supplying the refrigerant to the second refrigerator on the basis of the temperature of the object sensed by the temperature sensor.

16. The cooling apparatus according to claim 13, wherein the controller has means for supplying the second refrigerator with the refrigerant in an initial stage of cooling, and stopping the supply of the refrigerant to the second refrigerator after the refrigerant is supplied to the second refrigerator for a predetermined period of time.

17. The cooling apparatus according to claim 16, wherein the controller has a timer for counting the period of time for which the refrigerant is supplied to the second refrigerator, and means for controlling the supply of the refrigerant to the second refrigerator on the basis of the time period counted by the counter.

18. The cooling apparatus according to claim 13, wherein the first refrigerator is formed of one of a Gifford-McMahon refrigerating cycle type refrigerator, a Stirling refrigerating cycle type refrigerator, a modification-type Solvay refrigerating cycle type refrigerator, and a pulse tube refrigerator.

19. The cooling apparatus according to claim 13, wherein the second refrigerator is formed of one of a pulse tube refrigerator, a Gifford-McMahon refrigerating cycle type refrigerator, a Stirling refrigerating cycle type refrigerator, and a modification-type Solvay refrigerating cycle type refrigerator.

20. The cooling apparatus according to claim 13, wherein the first refrigerator includes a plurality of cooling stages, at least a first cooling stage included in the cooling stages using one of a Gifford-McMahon refrigerating cycle type refrigerator, a Stirling refrigerating cycle type refrigerator, and a modification-type Solvay refrigerating cycle type refrigerator, and cooling stages other than the first cooling stage using pulse tube refrigerating cycle type refrigerators connected in series to the refrigerator used in the first cooling stage.

21. A superconducting magnet apparatus comprising:

a superconducting coil unit; and a cooling unit for cooling the superconducting coil unit, including a first refrigerator, a second refrigerator connected parallel to the first refrigerator for circulating a refrigerant received from the first refrigerator, a valve through which the second refrigerator is connected parallel to the first refrigerator, and a controller for controlling the valve so as to regulate a flow of the refrigerant between the first and second refrigerators.

22. The superconducting magnet apparatus according to claim 21, wherein the cooling unit has means for directly cooling a superconducting coil included in the superconducting coil unit.

23. The superconducting magnet apparatus according to claim 21, wherein the cooling unit has means for directly cooling a container which contains a super-conducting coil included in the superconducting coil unit.

24. The superconducting magnet apparatus according to claim 21, wherein the second refrigerator has a plurality of refrigerators located in the super-conducting coil unit.

* * * * *